US009745735B2

(12) United States Patent
Stevenson et al.

(10) Patent No.: US 9,745,735 B2
(45) Date of Patent: Aug. 29, 2017

(54) INTAKE NOZZLE FOR SUCTION HOSE

(71) Applicants: David Stevenson, Canton, NY (US); Christopher Stevenson, Canton, NY (US)

(72) Inventors: David Stevenson, Canton, NY (US); Christopher Stevenson, Canton, NY (US)

( * ) Notice: Subject to any disclaimer, the term of this patent is extended or adjusted under 35 U.S.C. 154(b) by 693 days.

(21) Appl. No.: 14/317,816

(22) Filed: Jun. 27, 2014

(65) Prior Publication Data

US 2015/0376890 A1 Dec. 31, 2015

(51) Int. Cl.

| | |
|---|---|
| ***A47L 5/22*** | (2006.01) |
| ***E03F 1/00*** | (2006.01) |
| ***F04D 7/04*** | (2006.01) |
| ***E03F 7/10*** | (2006.01) |
| *E03F 7/08* | (2006.01) |
| *E03F 7/00* | (2006.01) |

(52) U.S. Cl.

CPC ..... *E03F 7/106* (2013.01); *A47L 5/22* (2013.01); *E03F 7/00* (2013.01); *E03F 7/08* (2013.01); *F04D 7/04* (2013.01); *F04D 7/045* (2013.01)

(58) Field of Classification Search

CPC ..... A47L 5/22; A47L 5/38; A47L 9/00; E03F 1/00; E03F 7/00; E03F 7/08; F04D 7/04; F04D 7/045; F04D 7/00

USPC .... 15/312.1, 312.2, 314, 409, 421; 210/258, 210/173, 174; 417/423.3, 423.9; 141/231

See application file for complete search history.

(56) References Cited

U.S. PATENT DOCUMENTS

| | | | |
|---|---|---|---|
| 3,969,446 | A | 7/1976 | Franklin, Jr. |
| 4,408,724 | A | 10/1983 | Meyer |
| 4,685,868 | A | 8/1987 | Bodensteiner et al. |
| 4,793,386 | A | 12/1988 | Sloan |
| 4,919,849 | A | 4/1990 | Litz et al. |
| 5,249,688 | A | 10/1993 | Hwang |
| 5,916,491 | A | 6/1999 | Hills |

*Primary Examiner* — David Redding

(74) *Attorney, Agent, or Firm* — Bernhard P. Molldrem, Jr.

(57) ABSTRACT

An intake nozzle fits onto the suction hose of a vacuum pumper truck. The nozzle comprises a tubular housing and the rotor within the housing near the intake end. The rotor includes a hollow cylindrical canister and spiral vanes on its exterior. Ambient air enters an air tube, penetrates the side of the housing and supplies ambient air to the interior of the canister. The air exits through outlet ports into the liquid waste as it moves past under vacuum. The injected air reduces the density of the liquid waste, speeding up the pumping process and reducing the incidence of blockages.

7 Claims, 4 Drawing Sheets

INTAKE NOZZLE FOR SUCTION HOSE

BACKGROUND OF THE INVENTION

The invention is directed to an intake nozzle that is placed on the end of a vacuum hose and is inserted into a septic tank or other reservoir of liquid waste so that the liquid waste can be sucked up into a vacuum tank on a pumper truck of the type that are used throughout the septic service industry.

Typically, the truck has a vacuum tank with a capacity of e.g., 3,600 gallons. A vacuum pump evacuates the tank to about minus 18 to minus 21 inches of mercury (about minus 10 psig), and the hose inserted into the septic tank sucks the waste up through the hose into the tank on the truck. It typically take about an hour to remove the liquid from a typical septic tank this way. Often, there are blockages in the vacuum hose that have to be dealt with and that delays the process. For deeper, vertical septic tanks, the weight of the liquid waste in the hose slows the suction action, and also creates weight that the pumper operator has to contend with when manipulating the hose. At the end of this process, the pumper operator has to clean out the hose, put the hose back on the truck, and drive to a septic disposal facility to dump the contents of the tank.

There is thus a need to increase the efficiency of the septic service process, i.e., reduce the time to empty the customer's septic tank, and to avoid problems with blockages in the suction hose and with having to manipulate the hose.

OBJECTS AND SUMMARY OF THE INVENTION

Accordingly, it is an object to provide an improvement for suction pumping of liquid waste to avoid the drawbacks present in the current systems.

It is another object to provide an intake nozzle for the suction hose that eases the flow of the liquid waste through the suction hose into the storage tank on the vacuum pumper truck, which reduces the time to pump out the customer's septic tank, and which reduces the problems of blockage and spillage.

According to an important aspect of the present invention, an intake nozzle is fitted onto the distal end of the suction hose, and incorporates a mechanism that mixes air into the liquid at the intake point. This action also floats the nozzle at or near the top surface of the liquid waste which makes it easier for the employee to manipulate the vacuum hose. This tool has been found to decrease the loading time from the typical one hour to about 24 minutes.

In a practical embodiment, the vacuum intake nozzle of this invention has a generally vertical tubular body, with a hollow rotor (or canister) inside, with the rotor having a number of twist or spiral vanes on its perimeter. An air intake tube on the outside of the tubular body penetrates the body or housing and connects with a hollow upper spindle or axle of the rotor. The intake tube can have a valve for regulating air flow. A bottom axle can also be present to serve as a rotary bearing for the lower end of the canister or rotor. There are one or more air outlet ports on the bottom part of the canister. The tubular body continues down a short ways and may have a perforated guard cap or cover to allow the liquid in but to block large solid chunks from getting into the nozzle. In some versions, the air outlet ports can be nozzles directing the air flow to produce rotation.

In operation, the hose is lowered into the septic tank, and the nozzle penetrates below the top surface. The vacuum pump in the pumper truck is turned on, which evacuates the tank, and eventually creates a suction inside the hose. This suction causes the liquid waste to start to move up into the nozzle and up the vacuum hose towards the pumper truck. The flow of the liquid past the rotor vanes causes the hollow canister to rotate, and the reduced pressure inside the nozzle causes the air inside the canister (which is at one atmosphere) to exit out the air outlet nozzles where it mixes with the liquid waste. The mixed-in air reduces the weight of the column of liquid waste within the hose, so there is a quicker and more consistent flow up into the waste storage tank on the truck. Once the liquid waste reaches the tank, the air quickly separates from it and is exhausted out by the vacuum pump. A water jet can be included at the lower end of the nozzle, to inject water into the liquid waste. This can facilitate pumping out of denser, heavy waste material near the bottom of the septic tank. The shape and dimensions of the nozzle can vary.

Most generally stated, the nozzle has an elongated tubular body or housing that defines a housing axis, which is usually oriented vertically. The housing has an upper end adapted to secure to a distal end of the suction hose, a lower end having at least one opening (to permit inflow of the liquid waste) so that the waste can be drawn up through the intake nozzle and suction hose into the storage tank of the pumper truck.

The rotor is disposed within the housing and has its rotational axis aligned with the housing axis. The rotor includes a hollow generally cylindrical canister which has an upper end, a generally cylindrical side wall, and a lower end, with the lower end being provided with one or more air outlet ports communicating the interior of the hollow canister with the quantity of liquid waste that is present in the nozzle.

An air inlet tube enters the side wall of the housing and has its outer end adapted to communicate with ambient air. The inner end of the air inlet tube is aligned with the axis of the canister to communicate with the interior thereof to permit ambient air to be drawn into the interior of the canister and thence into the liquid waste in the lower end of the housing. This action serves to aerate the liquid waste being drawn through the intake nozzle to facilitate passage of the waste through the suction hose into the storage tank.

The rotor may include one or more spiral vanes affixed onto the cylindrical side wall of the canister and adapted to induce rotation of said rotor when the liquid waste is drawn through the intake nozzle past the rotor. In some possible embodiments, the air outlet ports can be in the form of air jets to direct the air so as to impart rotary motion onto the rotor.

Preferably, the lower end of the housing includes a guard cap in which are formed a multiplicity of perforations, such that the liquid waste enters the lower end of the housing only through said perforations. The perforations are small enough so that large chunks of solid waste are blocked from entering into the intake nozzle. These may be a series of holes, or may be a grid or screen.

An optional water jet nozzle can be disposed on the end cap and oriented to direct a water jet towards the rotor, which can facilitate movement of the liquid waste near the bottom of the septic tank where the waste is heavy and dense. In that case, a hose connection extends from water jet nozzle to permit connection to a water hose.

The guard cap can include a rotary support member, i.e., bearing disposed on the axis of the nozzle housing to engage the axis of the rotor and permit free rotation of the rotor.

The inlet tube includes a valve to permit control of flow of air through the air inlet tube. In a favorable embodiment, where the housing upper end has a diameter adapted to match the associated suction hose, the housing has a bell portion of the housing, where the rotor is contained, and the bell portion can be of a greater diameter than the upper end of the housing.

One particular preferred embodiment is illustrated in the accompanying Drawing figures, which illustrate one implementation of the main principles of the invention.

DETAILED DESCRIPTION OF A PREFERRED EMBODIMENT

Figure 1:
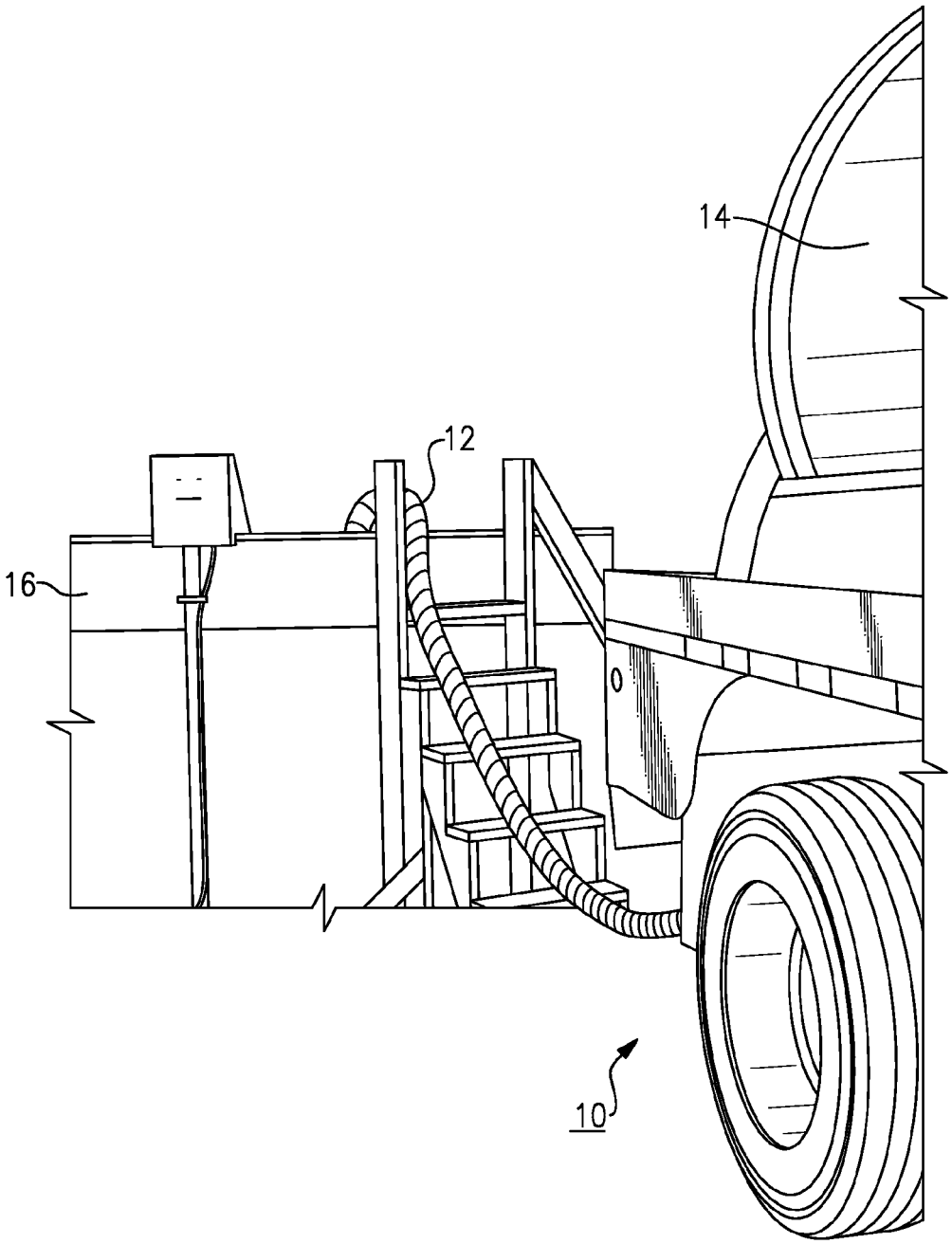
FIG. 1 is a perspective view showing suction hose extending from a pumper truck into a liquid waste storage tank.

FIG. 1 illustrates a typical implementation of a pumper truck 10 (here, only the rear end is shown), in which a suction hose 12 extends from a vacuum tank 14 on the truck into a customer's septic tank 16 so that the liquid waste in the septic tank can be pumped through the suction hose 12 into the vacuum tank 14. Here, the septic tank 16 is shown partly above ground, but is understood to extend down below the surface. The vacuum tank 14 has a nominal capacity of e.g., 3600 gallons. A vacuum pump (not shown) evacuates the tank 14 to about minus 18 to minus 21 inches of mercury (about minus 10 psig), and the hose 12 is inserted into the septic tank 16 so that it sucks the waste up through the hose into the tank on the truck. It takes about an hour to remove the liquid from a typical septic tank in this way. This process can be complicated if there are blockages in the vacuum hose, e.g., caused by solid chunks in the liquid waste that are large enough to become caught on the interior of the hose. These blockages have to be dealt with and that delays the process. For deeper, vertical septic tanks, the weight of the liquid waste in the hose slows the suction action, and also creates weight that the pumper operator has to contend with when manipulating the hose. At the end of this process, the pumper operator has to clean out the hose, put the hose back on the truck, and drive to a septic disposal facility to dump the contents of the tank 14. We have found that with our intake nozzle attached at the intake end of the suction hose 12, which mixes air bubbles into the liquid waste as it is drawn into the hose 12, and also agitates the liquid waste, the time required to pump out the customer's septic tank 16 is reduced from the typical one hour to a much shorter time below about 36 minutes or less, often down to 24 minutes, and there is a much reduced incidence of clogging or blockage.

Figure 2:
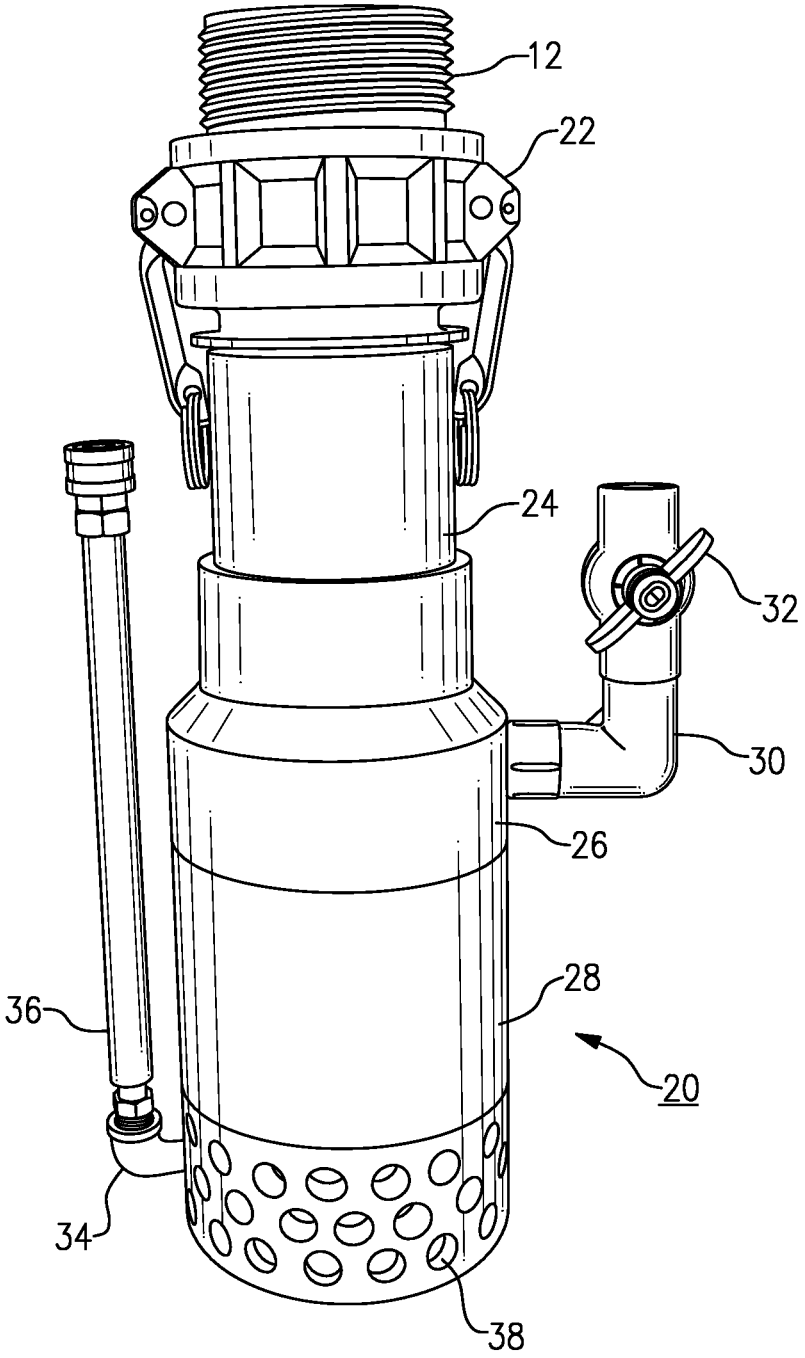
FIG. 2 is an elevation view of an intake nozzle according to an embodiment of this invention.

FIG. 2 shows one exemplary embodiment of the intake nozzle 20, here with a hose connector 22 at the top or proximal end of a tubular body 24, the connector being configured to couple to the distal end of the suction hose 12. An bell portion 26 of the tubular body, which is of a larger diameter, contains the rotor which will be discussed shortly, and an end cap portion 28 extends from the bell portion 26 to the distal end of the nozzle 20. An air inlet tube or pipe 30, open to the ambient, penetrates a side wall of the nozzle body 22 at or above the top of the bell portion 26, and this air inlet tube includes an air valve 32 that can control the flow of air into the air inlet tube and thence into the rotor.

The intake nozzle may include a water jet nozzle 34 disposed on the end cap 38, here oriented to direct a water jet towards the rotor 40 within the nozzle body, and a hose connector 36 adapted to permit connection to a water hose (not shown here).

Figure 3:
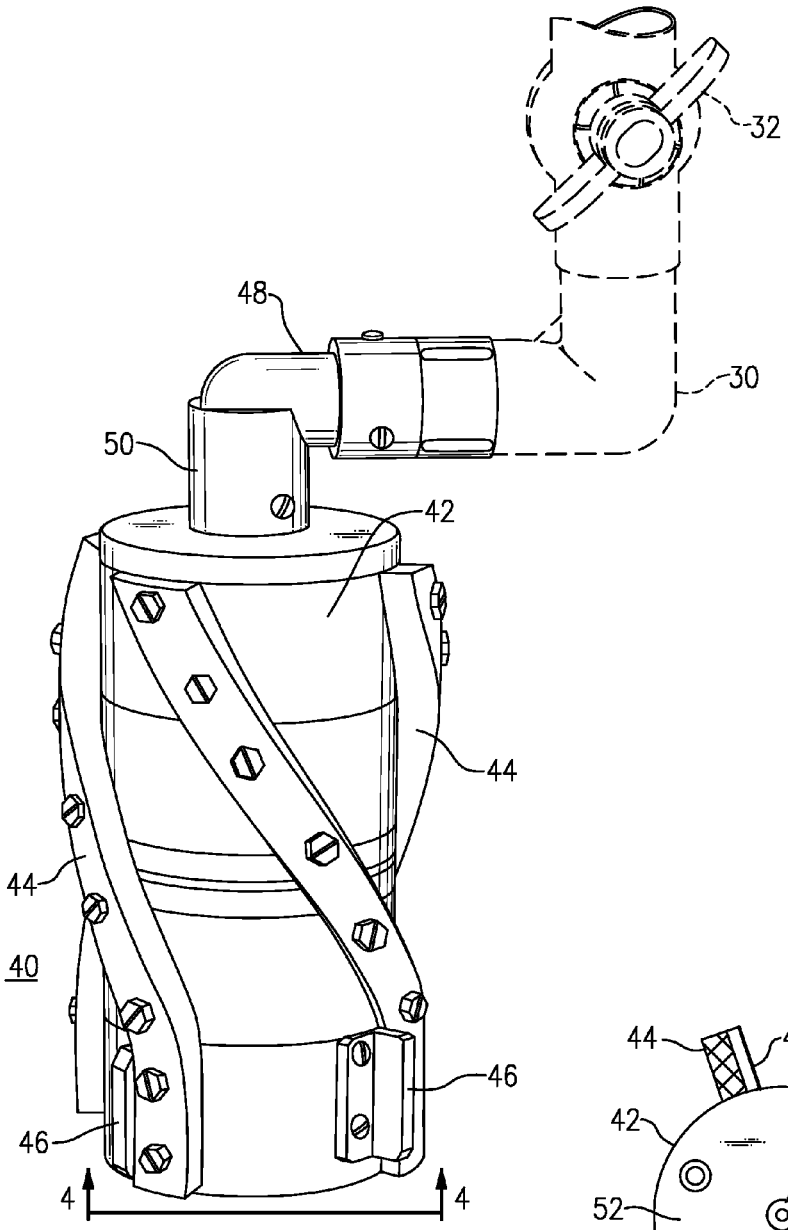
FIG. 3 showing the rotor portion of this embodiment, including canister, vanes, and air intake.

FIG. 3 illustrates the construction of the rotor 40, which here is formed of an elongated cylindrical canister 42 with a cylindrical side wall, a circular top wall and a circular bottom or end wall. A number of spiral or twist vanes 44 proceed diagonally along the cylindrical surface of the canister 42, and each of these is supported by a metal support blade 46 affixed to the lower of distal part of the canister 42. The vanes 44 are arranged so as to impart a rotary motion to the canister as the liquid waste is drawn past the canister and up the intake nozzle 20 when the hose and the nozzle are under suction. An interior portion 48 of the air intake tube 30 is shown here as an L-shaped member with a rotary connection 50 for supporting the rotor canister 44 at its axis, and allowing air to flow into the hollow interior of the canister.

Figure 4:
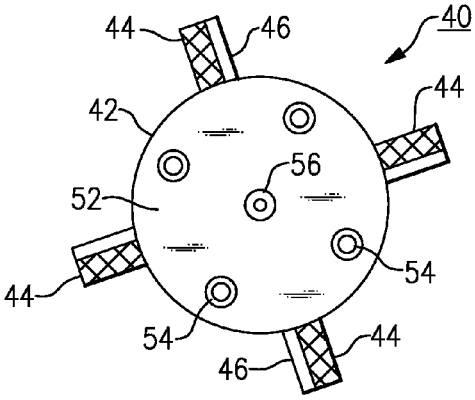
FIG. 4 is a bottom view thereof, taken on line 4-4, illustrating air outlet ports and a central pivot member.

The lower end of the rotor 40 is shown in FIG. 4. A lower circular end wall 52 is shown here with a number of air outlet ports 54 that communicate with the hollow interior of the canister 42. These ports 54 are distributed around the end wall 52. A central bearing or socket 56 (optional) is present at the center of the end wall 52 to receive a rotary support pin (not shown) which may be present at the center of the base or end of the end cap 28.

Figure 5:
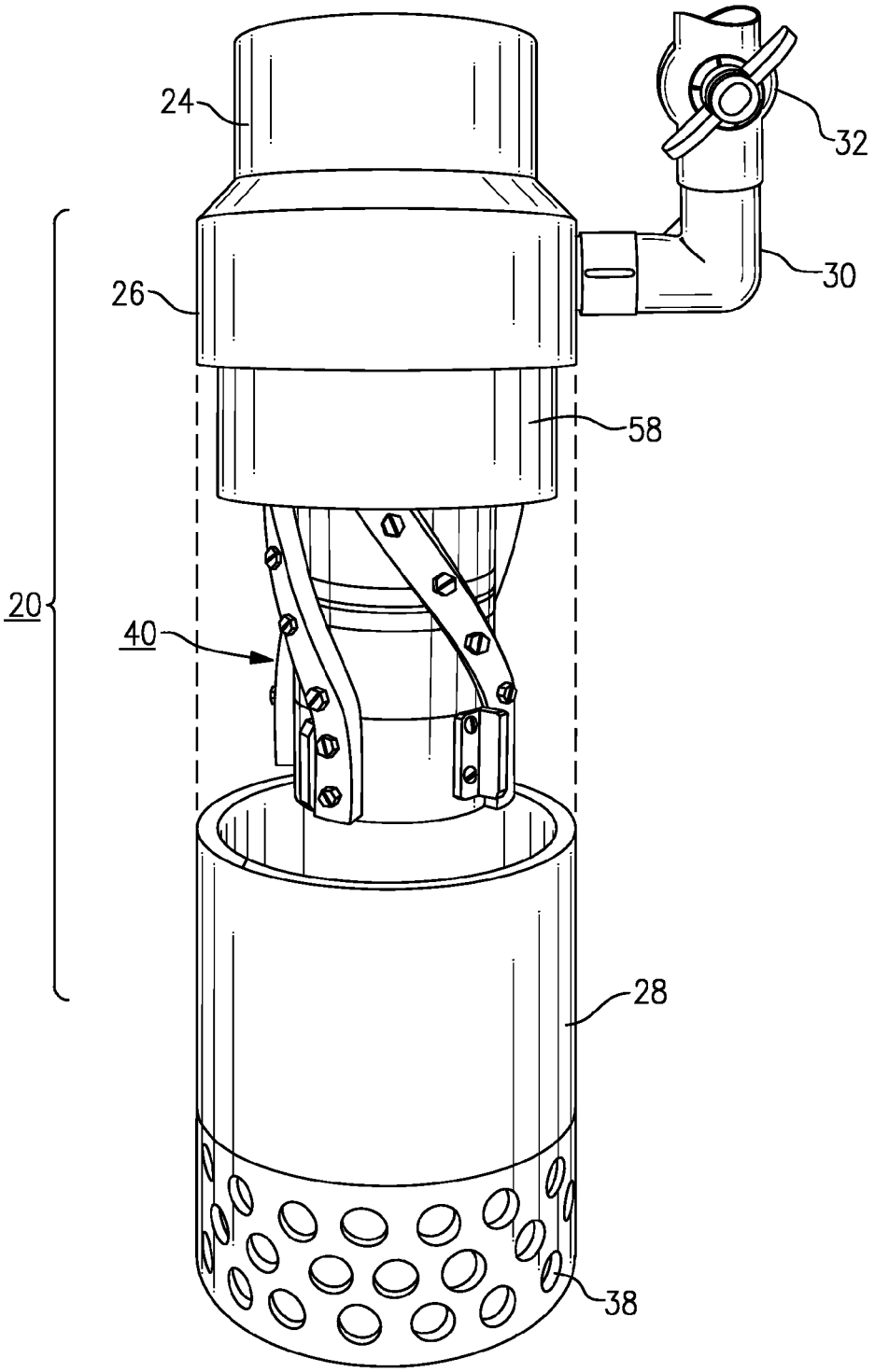
FIG. 5 shows the intake nozzle of this embodiment, with a lower end cap partly removed.

FIG. 5 shows the lower part of the intake nozzle 20 with the cap portion 28 detached to expose the lower part of the rotor 40. The upper part of the rotor is partially obscured within the upper portion of the bell 26. An annular flange or sleeve 58 projects down from the upper part of the housing or body at the bell portion 26. This fits within the cylindrical wall at the top of the end cap 28 and provides a surface for attaching the end cap. The interior portion 48 of the ambient air intake is also hidden in this view within the body or housing 24.

In practice, the operator will attach the intake nozzle 20 to the suction hose 12, extend the suction hose 12 from the truck 10 and then turn on the vacuum pump. Several minutes are required to evacuate the vacuum tank of the truck down to the operating pressure, e.g., minus 18 inches of mercury. The operator lowers the hose down into the customer's septic tank 16 until the lower tip of the nozzle is submerged in the liquid. Once the pressure in the vacuum tank 14 and hose 12 are reduced sufficiently, the vacuum will start to draw the liquid waste into the nozzle and thence up into the hose. The reduced pressure within the intake nozzle 20 induces a flow of ambient air into the ambient air intake tube 30, and from there into the hollow canister 42 of the rotor. The air escapes from the canister through the outlet ports 54 into the liquid waste as it passes vertically upward past the rotor. The moving liquid waste contacts the vanes 44 and spins the rotor. The combination of the air injection from the air outlet ports 44 and agitation from the spinning rotor 40 mixes air bubbles into the rising liquid waste. This action reduces the weight of the column of liquid inside the hose due to the presence of the air bubbles and also assists in preventing coagulation of materials in the hose so that blockages do not from. The lighter weight of the column of fluid also makes it easier for the operator to lift and manipulate the hose during the pumping operation.

Once the liquid reaches the vacuum tank 14 on the truck, the air bubbles quickly separate from the liquid and the air is pumped back into the ambient. Because the presence of injected air makes the liquid less dense while in the vacuum hose, the liquid pumps much faster, so that the usual pumping time of one hour is reduced, usually to about 24 minutes.

When the septic tank 16 is pumped out to near the bottom, the operator may apply water under pressure to the optional water jet 34, which can assist in thinning out accumulations of denser waste at the bottom of the septic tank.

A number of variations of the intake nozzle of the present invention are possible. For example, a narrow nozzle having a three-inch diameter tubular body or housing, to match the diameter of the vacuum hose 12, can have a smaller rotor, e.g., with a 1½ inch diameter body or canister. The ambient air intake can connect at the lower side of the canister, instead of at the top end, and can serve as a main support spindle for the canister. As another alternative, the housing or body of the intake nozzle can have an elongated lower end portion that extends below the location of the rotor. In other versions, the air outlet ports may be present on the side wall of the canister rather than only at the bottom, and in other versions the air outlets may be in the form of air jets directing the air in a direction to assist in rotating the canister.

While the illustrated embodiment is adapted for use with a pumper truck, a nozzle of this construction could find other applications where material is to be picked up and moved through a vacuum hose or suction hose.

While the invention has been described in terms of a preferred embodiment, many additional variations thereof are possible and would present themselves to persons of skill in the art without departing from the scope and spirit of this invention.

What is claimed is:

1. An intake nozzle for a liquid waste suction hose, comprising a generally elongated tubular housing defining a housing axis and having an upper end adapted to secure to a distal end of the suction hose, a lower end having at least one opening and adapted to be inserted into a quantity of liquid waste so that the waste can be drawn up through the intake nozzle and suction hose into a storage tank;

a rotor disposed within said housing and having a rotational axis aligned with said housing axis, the rotor including a hollow generally cylindrical canister which has an upper end, a generally cylindrical side wall, and a lower end, the lower end having one or more air outlet ports communicating the interior of the hollow canister with said quantity of liquid waste;

an air inlet tube entering a side wall of said housing and having an outer end adapted to communicate with ambient air and an inner end aligned with the axis of the canister to communicate with the interior thereof to permit ambient air to be drawn into the interior of the canister and thence into the liquid waste in the lower end of the housing, thereby to aerate the liquid waste being drawn through the intake nozzle to facilitate passage of the waste through the suction hose into the storage tank.

2. The intake nozzle according to claim 1 wherein said rotor further includes one or more spiral vanes affixed onto the cylindrical side wall of said canister and adapted to induce rotation of said rotor when the liquid waste is drawn through the intake nozzle past said rotor.

3. The intake nozzle according to claim 1 wherein said lower end of said housing includes a guard cap in which are formed a multiplicity of perforations, such that the liquid waste enters the lower end of the housing only through said perforations.

4. The intake nozzle according to claim 3 further comprising a water jet nozzle disposed on said end cap and oriented to direct a water jet towards said rotor, and a hose connection extending from said water jet nozzle and adapted to permit connection to a water hose.

5. The intake nozzle according to claim 3 wherein said guard cap includes a rotary support member disposed on an axis of the nozzle housing to engage the rotor at its axis and permit free rotation thereof.

6. The intake nozzle according to claim 1 wherein said air inlet tube includes a valve to permit control flow of air through the air inlet tube.

7. The intake nozzle according to claim 1, wherein said housing upper end has a diameter adapted to match the associated suction hose, and a bell portion of the housing contains the rotor and has a greater diameter than the upper end of the housing.

* * * * *